US005460062A

United States Patent [19]

Wilson, Jr.

[11] Patent Number: 5,460,062

[45] Date of Patent: Oct. 24, 1995

[54] REACTION UNIT FOR THREADED CONNECTOR MANIPULATING DEVICE AND COMBINATION THEREOF

[75] Inventor: David Wilson, Jr., Longmont, Colo.

[73] Assignee: Dynamic Aerospace Tools Company, Boulder, Colo.

[21] Appl. No.: 276,506

[22] Filed: Jul. 18, 1994

Related U.S. Application Data

[63] Continuation of Ser. No. 25,949, Mar. 3, 1993, abandoned.

[51] Int. Cl.[6] ..... B25B 17/00

[52] U.S. Cl. ..... 81/56; 81/57.14; 81/57.16; 81/57.3; 81/57.34

[58] Field of Search ..... 81/55, 52, 57–57.14, 81/57.16, 57.28–57.34, 58.2

[56] References Cited

U.S. PATENT DOCUMENTS

| | | | |
|---|---|---|---|
| 1,477,184 | 12/1923 | Ormsby | 81/55 |
| 1,648,134 | 11/1927 | Kientz | 81/57.3 |
| 2,505,186 | 4/1950 | Hubbard | 81/55 X |
| 2,537,175 | 1/1951 | Viets | 81/58.2 |
| 2,578,686 | 12/1951 | Fish . | |
| 2,630,731 | 3/1953 | Imboden . | |
| 2,649,823 | 8/1953 | Markovich | 81/58.2 |
| 3,477,318 | 11/1969 | Batten . | |
| 3,620,105 | 11/1971 | Batten . | |
| 3,812,745 | 5/1974 | Wehmeyer . | |
| 4,374,479 | 2/1983 | Minotti . | |
| 4,402,239 | 9/1983 | Mooney | 81/57.34 X |
| 4,928,559 | 5/1990 | Stielow . | |
| 4,972,741 | 11/1990 | Sibille | 81/57.16 |
| 5,050,463 | 9/1991 | Stielow . | |

*Primary Examiner*—James G. Smith
*Attorney, Agent, or Firm*—Harold A. Burdick

[57] ABSTRACT

A device for manipulating threaded connectors is disclosed, the device being particularly well suited for manipulating line fittings. The device includes a socket and compact drive assembly which are configured to assure reliable transfer of power to the socket from a driver releasably attachable with the device. The socket has a split side wall with a gap defined thereby which is smaller than the fitting to be manipulated, and has facets at the inner periphery thereof sufficient in number to prevent substantial linear movement of the socket in any direction having at least a component normal to the axis of rotation of the fitting once the fitting is engaged. A fully integrated torque reaction unit, a rotation inhibitor for stabilizing the socket relative to the housing when not under power, and various sockets and attachments are described.

19 Claims, 7 Drawing Sheets

REACTION UNIT FOR THREADED CONNECTOR MANIPULATING DEVICE AND COMBINATION THEREOF

RELATED APPLICATION

This application is a Continuation of U.S. patent application Ser. No. 08/025,949 filed Mar. 3, 1992 by David Wilson, Jr. and entitled "Compact manipulating Device For Threaded Connectors, which application is now abandoned.

FIELD OF THE INVENTION

This invention relates to devices for applying and/or removing connectors, and, more particularly, relates to tools attachable to a power driver for manipulating threaded connectors.

BACKGROUND OF THE INVENTION

While many devices for manipulating threaded connectors have been heretofore known and/or utilized, a problem persists in their application and use when the connector to be manipulated is located in a cramped, distant or awkward to reach space, or is out of the line of sight. This has been particularly true where the threaded connector being manipulated is a line fitting (various types of which are utilized to join the ends of conduits, cables, and the like to each other or to another component in a mechanical and/or electrical system), application and use of such heretofore known devices frequently involving at least partial disassembly of associated structure or components to gain access to the line fitting and/or frequently involving some risk of damage to the fitting.

Perhaps the most common of such heretofore known devices are simple box wrenches or fitting wrenches. However, use of such standard wrenches, involving movement of the handle of the wrench through a significant arc, is not well suited to applications in cramped locations, or where a plurality of line fittings are extremely closely positioned relative to one another (at least where one does not wish to remove all fittings in a series, or row, of fittings leading to the targeted fitting). Additionally, use of these well known types of wrenches necessarily involve a "hands-on" operation, and, where a second fitting on the line associated with the fitting to be manipulated must be stabilized (for example, to avoid twisting of the line), frequently require use of two wrenches each of which must be held by the user.

Various tools have been suggested to reach fasteners located in cramped areas and/or for application with a power driver (see, for example, U.S. Pat. Nos. 3,477,318, 3,620,105, 2,578,686, 4,374,479, 4,928,559, 5,050,463 and 2,630,731), with such devices, however, likewise not providing for minimal manual manipulation of the tool during operation and/or not optimizing ease of utility, mechanical durability and thus reliability, and compactness of structure. Further improvements in such tools could thus still be utilized.

SUMMARY OF THE INVENTION

This invention provides a compact device for manipulating threaded connectors, for example a line fitting while such fitting is in place on the line, a unit for stabilizing an associated part of the threaded connector, and a socket of one piece construction rotatable in such a device with the socket including an extended portion thus allowing access of the socket to closely spaced fittings.

The device of this invention includes a socket rotatably mounted in a compact housing, is releasably engagable with a power driver, and is configured to minimize the necessity for preliminary manipulation of any of the device, the connector or the surrounding equipment or structure to achieve positioning of the device on the connector or operation of the device, to enhance durability of the components of the device and thus its reliability, and to minimize the likelihood of damaging and/or disengaging from the connector during operation. The device may include means for inhibiting rotation of the socket relative to the housing when driving power in not being applied to the device.

The socket of the device of this invention has an inner periphery and an engageable outer periphery together defining a part of a side wall, the side wall having a gap therein to allow positioning of the socket around the line by passage of the line through the gap, the gap being defined between spaced edges of the side wall and having a size between the spaced edges less than the fitting size. The inner periphery of the socket has a plurality of facets sufficient in number to prevent substantial linear, as opposed to intended rotational, movement of the socket relative to the fitting in any direction having at least a component normal to the axis of rotation of the fitting once the fitting is engaged by the socket at the inner periphery thereof.

The housing has a gap at one part thereof and drive means mounted therein for imparting rotational motion to the socket, the drive means having a portion configured to be releasably engaged with the power driver, the gaps being in register when the socket is rotated to a selected position.

The drive means is engageable with the outer periphery of the socket and includes at least a first gear rotatably mounted in the housing. A rotation inhibitor is preferably mounted in the housing and is engageable with the socket or the first gear of the drive means for preventing rotation of the socket relative to the housing when no drive power is being applied from the driver while allowing rotation when drive power is being applied.

The unit for stabilizing an associated part of the threaded connector, for example a first part of a threaded connector assembly, is configured for integrated use with a device for manipulating a second part of the connector assembly. The unit includes a head for engaging the first part of the connector assembly and a stabilizer joined with the head and received at a portion of the device which is normally stationary during manipulation of the second part of the connector assembly, thus limiting movement of the head during the manipulation of the second part of the connector assembly. The stabilizer is preferably received through at least a first aperture at the normally stationary portion of the device, the stabilizer and the aperture being configured to permit substantially non-rotational relative movement of the stationary portion of the device and the stabilizer.

It is therefore an object of this invention to provide an improved device for manipulating threaded connectors which is more compact relative to the connector to be manipulated than heretofore known devices.

It is another object of this invention to provide a device for manipulating threaded connectors which is configured to minimize the necessity of manual manipulation to achieve positioning on a connector and operation of the device.

It is another object of this invention to provide a device for manipulating threaded line fittings that is configured to enhance durability and reliability of the device.

It is still another object of this invention to provide a device releasably engageable with a power driver for manipulating threaded line fittings that includes a socket configured to minimize the likelihood of damage to the fitting and/or disengagement of the socket from the fitting during operation.

It is still another object of this invention to provide a device releasably attachable to a power driver for manipulating threaded connectors that includes means for inhibiting rotation of a socket relative to a housing when driving power is not being applied to the device.

It is yet another object of this invention to provide a unit for stabilizing a first part of a line fitting assembly, the unit being fully integrated with a device for manipulating a second part of the line fitting.

It is yet another object of this invention to provide a socket of one piece construction that is receivable in a device for manipulating line fittings and having a portion which extends a selected distance away from the device to allow access of the socket to closely spaced fittings.

It is yet another object of this invention to provide a compact device for manipulating a threaded line fitting while the fitting is in place around the line, the line fitting having a fitting size relating to a part of the fitting to be engaged by the device, the device for releasable engagement with a power driver and including a socket having an inner periphery and an engageable outer periphery together defining a part of a side wall, the side wall having a gap therein to allow positioning of the socket around the line by passage of the line through the gap, the gap being defined between spaced edges of the side wall and having a size between the spaced edges less than the fitting size, and a compact drive transfer assembly including a housing having the socket rotatably mounted therein, the housing having a gap at one part thereof, and drive means mounted in the housing for imparting rotational motion to the socket and having a portion configured to be releasably engaged with the driver, the gaps being in register when the socket is rotated to a selected position.

It is still another object of this invention to provide a compact device for manipulating a threaded line fitting while the fitting is in place around the line which includes a socket having an inner periphery and an engageable outer periphery together defining a part of a side wall, the side wall having a gap therein to allow positioning of the socket around the line, the inner periphery having a plurality of facets sufficient in number to prevent substantial linear, as opposed to intended rotational, movement of the socket relative to the fitting in any direction having at least a component normal to the axis of rotation of the fitting once the fitting is engaged by said socket at the inner periphery thereof.

It is yet another object of this invention to provide a manipulating device for threaded connectors which is attachable to a power driver, the device having a housing, a socket having an engageable outer periphery rotatably mounted in the housing, a drive transfer releasably engageable with the driver and engageable with the outer periphery of the socket for causing rotational motion thereof, the drive transfer including at least a first gear rotatably mounted in the housing, and a rotation inhibitor mounted in the housing and engageable with the socket or the first gear of the drive transfer for preventing rotation of the socket relative to the housing when no drive power is being applied from the driver while allowing rotation when drive power is being applied.

It is yet another object of this invention to provide a unit for stabilizing a first part of a threaded connector assembly, the unit for use with a device for manipulating a second part of the connector assembly, the device having a first portion that is movable for manipulating the second part of the connector assembly and a second portion that is normally relatively stationary during the manipulation, the unit comprising a head for engaging the first part of the connector assembly and a stabilizer joined with the head and received at the second portion of the device for limiting movement of the head during the manipulation of the second part of the connector assembly.

It is still another object of this invention to provide a unit for stabilizing a first part of a threaded line fitting assembly while the assembly is in place on the line, the unit for use with a device for manipulating a second part of the line fitting assembly, the device having a socket that is engagable with, and rotatable for manipulating, the second part of the line fitting assembly and a housing having the socket rotatably mounted therein and that is normally relatively stationary during the manipulation, the unit including a stabilizer joined with a head engageable with the first part of the fitting, the stabilizer received through at least a first aperture at the housing of the device for limiting rotational movement of the head during the manipulation of the second part of the line fitting assembly, the stabilizer and the aperture being configured to permit substantially non-rotational relative movement of the housing of the device and the stabilizer.

It is still another object of this invention to provide a socket of one piece construction rotatably receivable in a device for manipulating a threaded line fitting while the fitting is in place around the line, the line fitting having a fitting size relating to a part of the fitting to be engaged by the socket, the device for releasable engagement with a power driver at drive means mounted in the device for imparting rotational motion to the socket, the socket having a drivable periphery and a side wall that extends through an opening in the device with an end of the socket spaced a selected distance away from the device, the side wall having a gap therein to allow positioning of the socket around the line by passage of the line through the gap.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
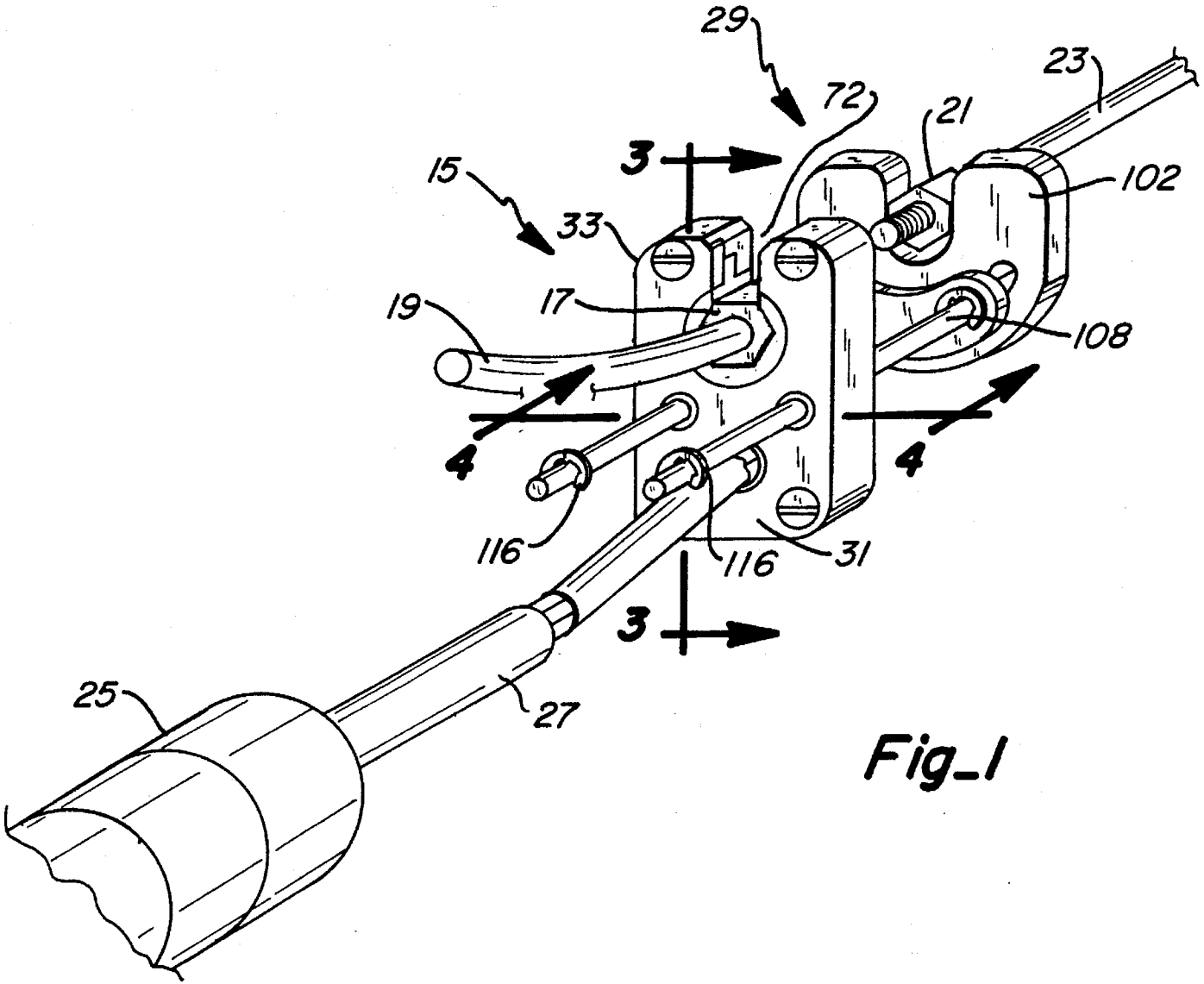
FIG. 1 is a perspective view showing both the drive assembly and socket unit and the torque reaction unit of this invention.

The preferred embodiment 15 of the device for manipulating threaded connectors is illustrated in FIGS. 1 through 4. Device 15 is shown in FIG. 1 in use to manipulate line fitting 17 around line segment 19 into engagement or disengagement with matable fitting 21 around line segment 23. Device 15 is releasably engaged with power driver 25 using flexible shaft 27 and, while usable without further attachments, employs torque reaction, or stabilizing, unit 29 of this invention to hold fitting 21 during manipulation of fitting 17 to avoid damage to line segments 21 and/or 23.

Figure 2:
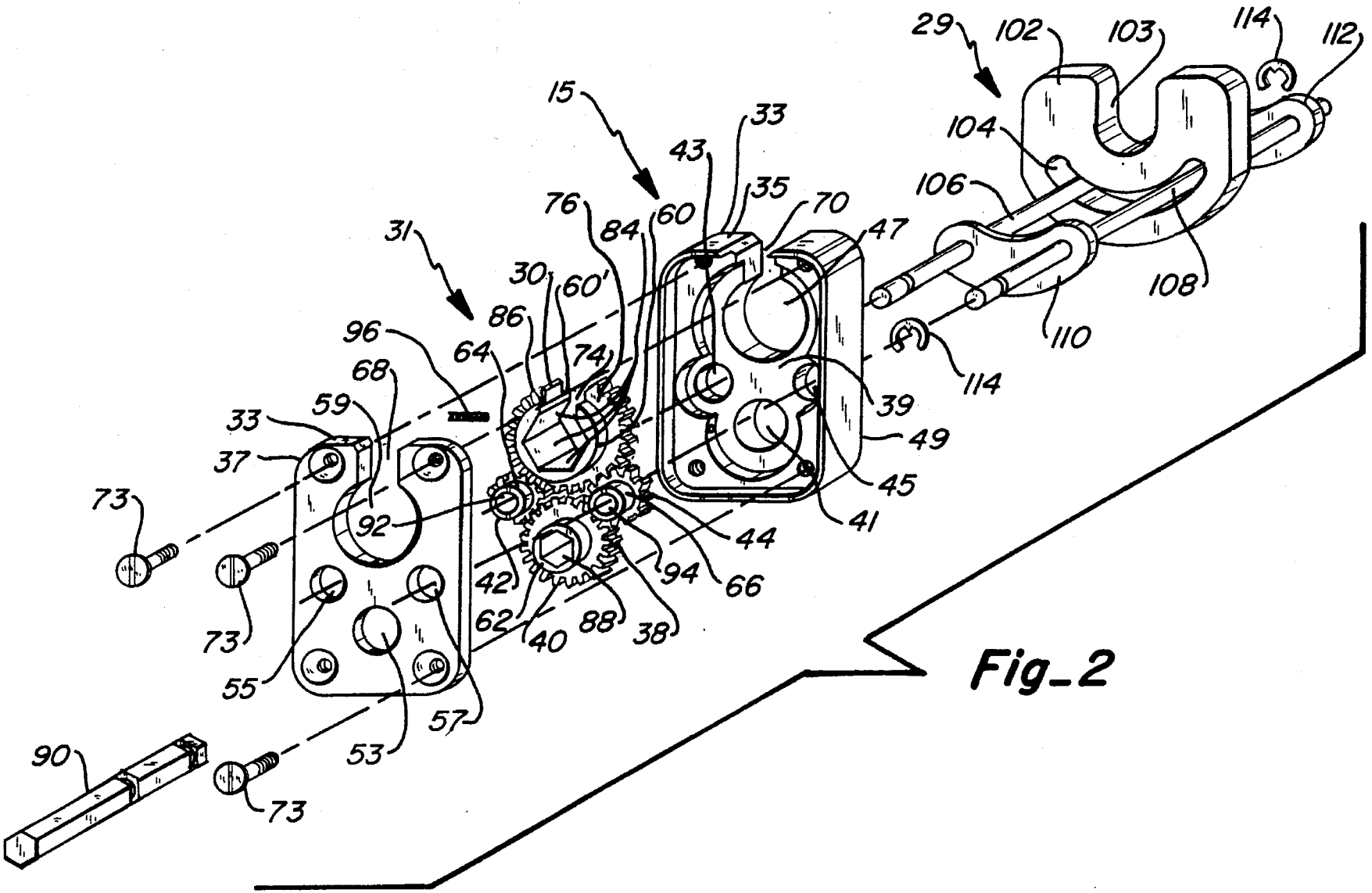
FIG. 2 is an exploded view of the units of FIG. 1.
Figure 4A:
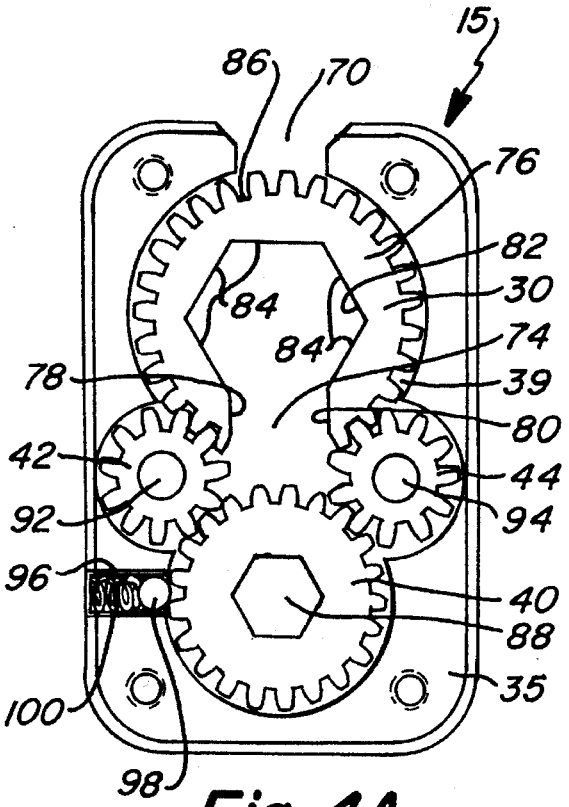
FIGS. 4A and 4B are sectional views taken through section line 4—4 of FIG. 1.
Figure 3:
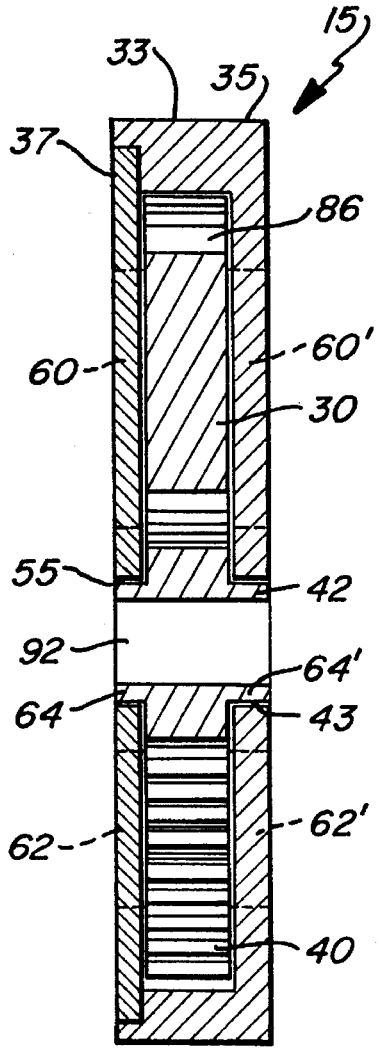
FIG. 3 is a sectional view taken through section line 3—3 of FIG. 1.

Turning to FIGS. 2, 3 and 4, device 15 includes socket 30 and drive transfer assembly 31. Drive transfer assembly 31 includes housing 33, formed by main housing body 35 and cover section 37, and gear train 38 including main drive gear 40 and linkage gears 42 and 44 for imparting rotational motion to socket 30 when driven by driver 25. Housing body 35 has indented structure 39 formed therein and openings 41, 43, 45 and 47 through rear wall 49 for housing socket 30 and drive transfer assembly 31. Cover section 37 includes openings 53, 55, 57 and 59, the corresponding openings in body 35 and cover section 37 receiving arcuate shoulders 60, 60', 62, 62', 64, 64', and 66, 66' (66' not shown but being substantially the same as 64') of socket 30 and gears 40, 42 and 44, respectively, thus eliminating any need for axles, shafts, bearings and the like.

Both cover section 37 and main body 35 include gaps 68 and 70, respectively extending from openings 59 and 47, respectively, the thus formed gap 72 in housing 33 (when assembled, utilizing, for example, machine screws 73, only 3 of which are shown in FIG. 2) corresponding in size to gap 74 formed in side wall 76 of socket 30 between spaced edges 78 and 80 thereof. Side wall 76 is defined between inner periphery 82 (which may be variously configured for receiving the connector to be manipulated, a hex fitting configuration with a plurality of facets 84 being illustrated herein) and the outer periphery of the socket which includes engagable outer periphery 86 as well as the outer periphery of shoulders 60 and 60'.

Drive gear 40 includes power driver attachment opening 88 for receipt of a rotatable shaft (such as flex shaft 27 or rigid shaft 90). Linkage gears 42 and 44 may be solid, or may be bored to provide apertures 92 and 94 where stabilizing unit 29 will be utilized. Gear 40 and socket 30 are preferably of a size relative to one another to provide gear reduction (for example, about a 20% reduction). The housing, socket and gears are preferably formed of metals, though various plastics could be utilized in some applications for some of the parts of the device. While various sizes of device 15 are employed depending upon the size of connector involved, all are compact relative to the task, compactness, as well as durability, being achieved because of the particular relationship of gap size and gear sizes and/or placement of gears.

In one particularly useful embodiment of the device, overall measurements of the device are less than about 4 cm (3.2 cm) by 6 cm (5 cm) by 1.5 cm (0.9 cm) with a gap size of about 0.8 cm. This embodiment is utilized, for example, with a 1 cm hex nut, thus providing a gap which is no more than about 75% the size of the fitting. In this manner, once the line is passed through the gap and the fitting is engaged, no non-rotational movement of the socket relative to the fitting in directions normal to the axis of rotation of the fitting can occur, sufficient facets 84 being provided to hold the fitting and socket in engagement. Thus, the likelihood of damage to and/or disengagement from the fitting is reduced during operation of the device.

Moreover, by reducing the size of the gap, linkage gears 42 and 44 can be more closely spaced while still retaining, and in fact improving, sufficient engagement with outer periphery 86 of socket 30 (two cogs being engaged by each linkage gear except during passage of gap 74, assuring a minimum of two cog engagement at all times) thereby diminishing the likelihood of damage to the gears and thus failure of the device. This may be achieved with linkage gear spacing at their nearest point substantially equal to gap size.

For example, utilizing the embodiment above discussed, the linkage gears can be positioned with the angle defined by lines extending between the axis of rotation of the socket and the axes of rotation of each of the linkage gears at about 73.66°. With about a 0.8 cm gap, the angle defined by lines extending between the axis of rotation of the socket and each of the edges of the side wall is about 48° (a ratio of about 1.5 to 1).

Figure 4B:
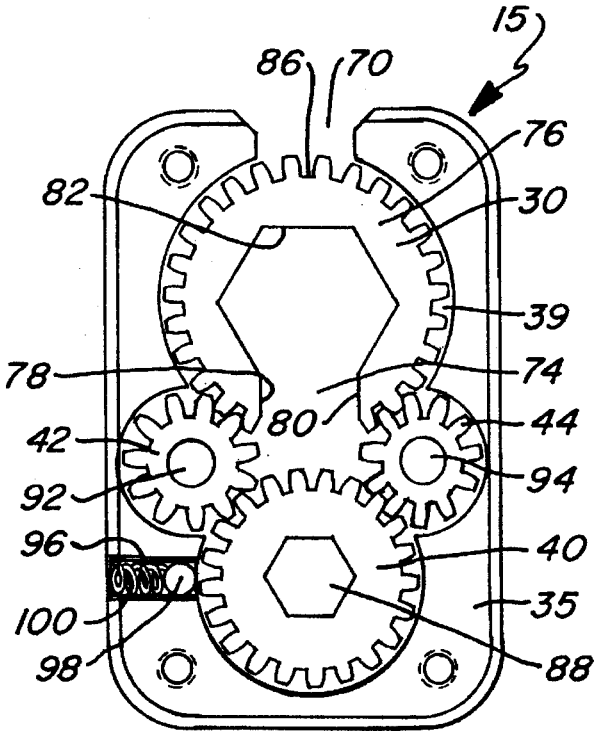
Figure 5C:
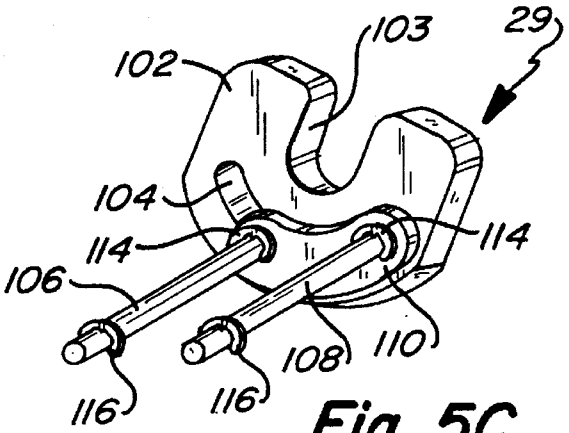
FIGS. 5A through 5C are perspective views of the torque reaction unit of FIG. 1.
Figure 5A:
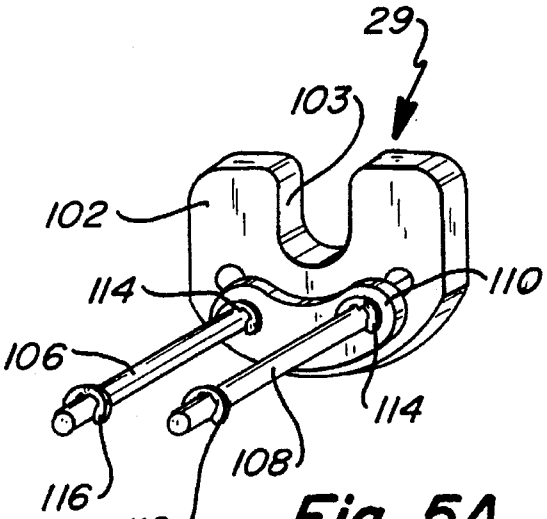
Figure 5B:
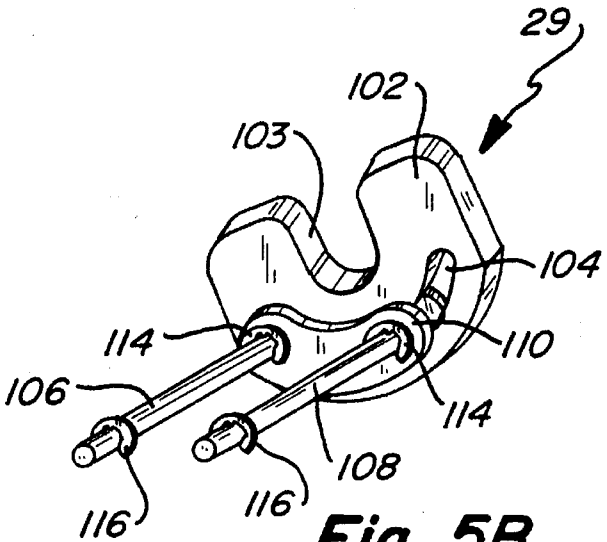

In accord with another aspect of this invention, means for inhibiting rotation of the socket relative to the housing when power is not being applied to the device is provided to allow for placement of the socket on the connector without free rotation thus allowing greater ease of use. Threaded ball plunger 96 is threaded into housing body 35 and includes, as is well known, ball 98 biased by spring 100. Since ball 98 is biased into engagement with gear 40 (the ball plunger could be applied to any of the gears or the socket), without power applied to rotate the gear, the gear, and thus the socket will be held in place (FIG. 4A), while application of rotary power from the driver will overcome the bias thereby allowing intended rotation of the socket (FIG. 4B).

FIGS. 1, 2 and 5A through 5C show the preferred embodiment of torque reaction unit 29 of this invention. Unit 29 includes head 102 having connector receiving slot 103 and arcuate slot 104 defined therethrough. Slot 104 receives stabilizing bars, or rods, 106 and 108 therethrough, the rods being held in place relative to one another by spacers 110 and 112 secured by retaining rings 114. This arrangement allows a range (about 120° where used with hex nuts) of motion sufficient to allow maneuvering of slot 103 into place holding connector 21 while still serving to stabilize line 23 when power is applied to the device 15 (see FIGS. 5A–5C).

Rods 106 and 108 are slidably received through apertures 92 and 94, respectively, of gears 42 and 44 at housing openings 43, 45, 55 and 57, respectively, and are secured at their ends by retainer rings 116. Since the coefficient of kinetic friction is substantially less than the coefficient of static friction, when device 15 is under power with gears 42 and 44 rotating, rods 106 and 108 will much more readily slide in apertures 92 and 94 than will head 102 (at slot 103) against fitting 21. This differential in frictional forces allows head 102 to remain in engagement with fitting 21 while fitting 17 is being applied or removed, distance variation being more readily compensated by sliding of rods 106 and 108 in apertures 92 and 94. Of course the differential can be improved by careful choice of materials forming unit 29 and gears 42 and 44.

Figure 6:
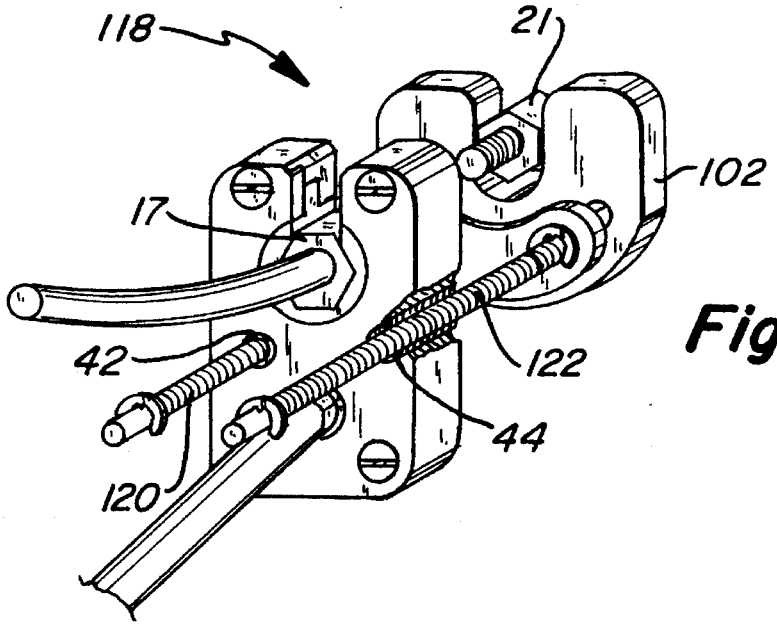
FIG. 6 is a perspective view with a cutaway portion illustrating a second embodiment of the torque reaction unit of this invention.

A second embodiment 118 of the stabilizing unit of this invention is illustrated in FIG. 6. Unit 118 is similar in most regards to the unit heretofore described except for use of threaded rods 120 and 122 and provision of mating threads in threaded apertures 124 and 126. Where a level of delicacy of the operation warrants, the threads are about the same size as the threads of fitting 17/21 but reversed in direction thus providing quite precise tandem movement of fitting 17 and gears 42/44 on rods 120/122.

Figures 7, 8:
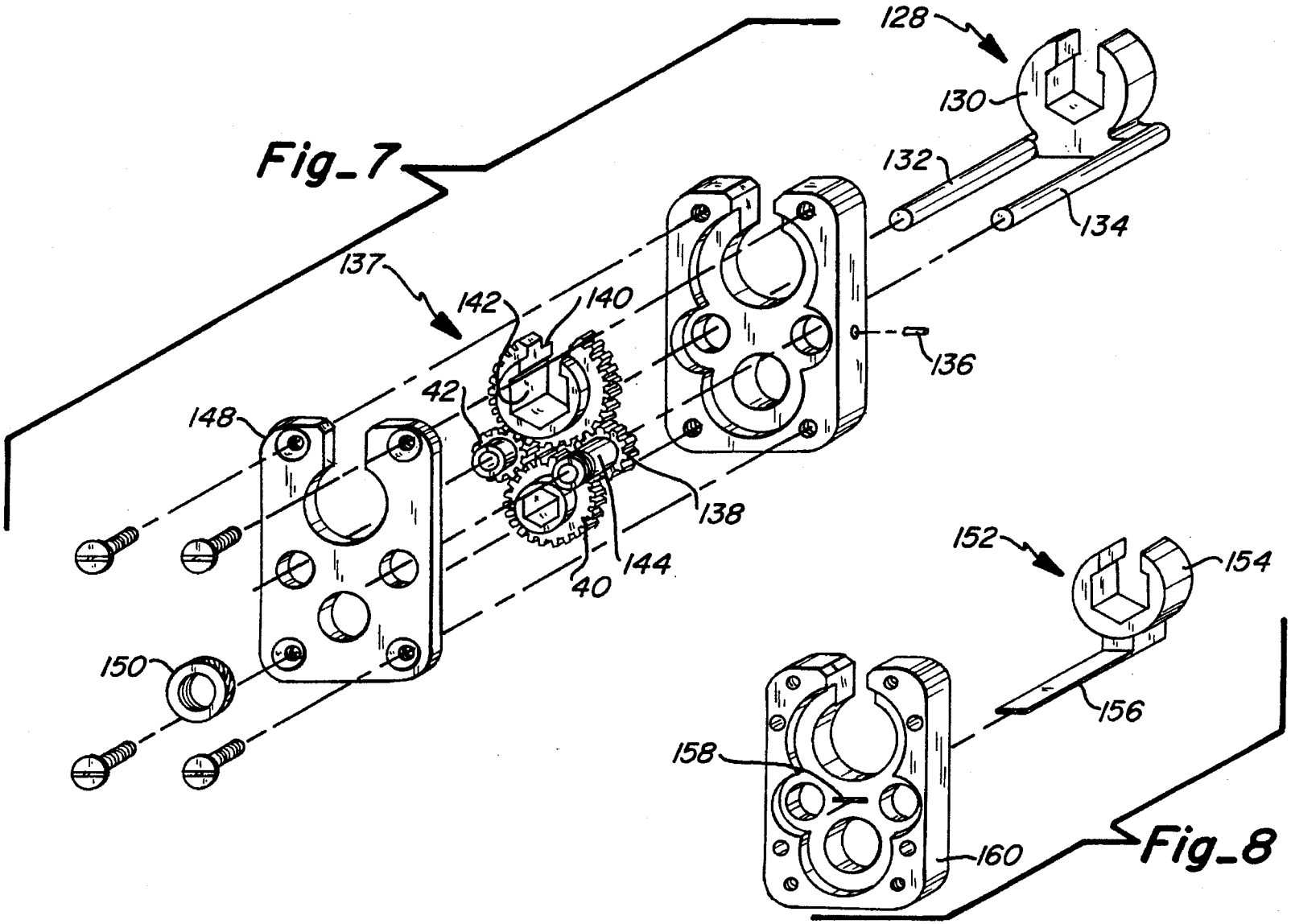
FIG. 7 is an exploded view of another embodiment of this invention.
FIG. 8 is a partial exploded view of another embodiment of the torque reaction unit of this invention.

FIG. 7 shows another embodiment 128 of the stabilizing unit of this invention, a one piece construction incorporating head 130 and bars 132 and 134. In addition, ball plunger 136 of manipulating device 137 is positioned for engagement with linkage gear 138, and socket 140 is reconfigured with hex-shaped inner periphery 142 differently oriented (sufficient facet contact being maintained). Linkage gear 138 includes elongated shoulder 144 extending through opening 146 of cover section 148, the shoulder being threaded at its outer terminus. Thumb wheel 150 is engageable at the threaded terminus of shoulder 144 for manual rotation, and thus fine positioning, of socket 140.

FIG. 8 shows yet another embodiment 152 of the stabilizing unit wherein head 154 is fixed to stabilizing tongue 156. Tongue 156 is slidably received through slot 158 in main housing body 160 (a similarly positioned slot being positioned in the cover section, not shown) and resides in the housing in the space between linkage gears and drive gear and socket.

Figure 9A:
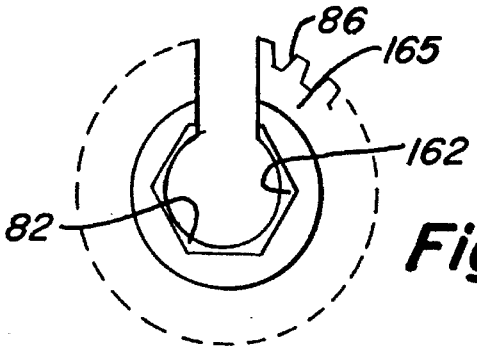
FIGS. 9A and 9B are front and rear, respectively, elevation illustrations of an alternative feature of the connector engaging socket of this invention.
Figure 9B:
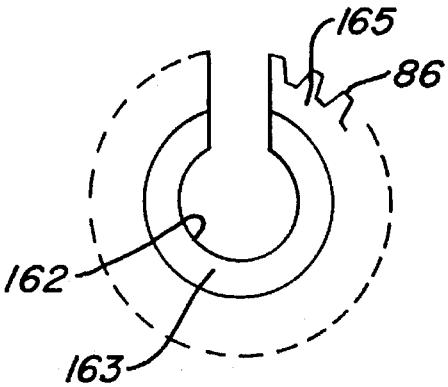

An alternative feature of the sockets of this invention is shown in FIGS. 9A and 9B comprising lip 162 extending radially inwardly from rear wall 163 of socket 165 (which is in all other respects like the sockets described herein). By provision of lip 162, connectors may be driven or removed (depending on orientation of the socket relative to the connector) without concern for axial disengagement of the socket and the connector during operations since relative axial movement therebetween is limited to a single direction.

Figure 10:
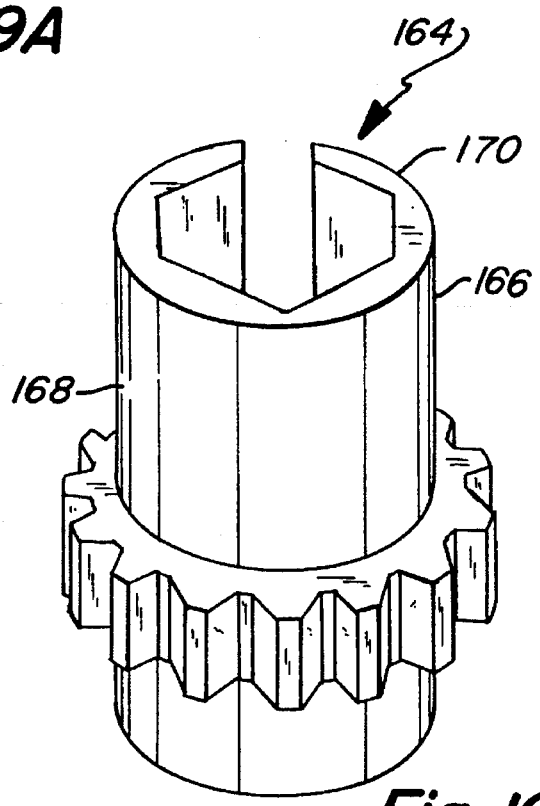
FIG. 10 is a perspective view of the extended connector engaging socket of this invention.
Figure 11:
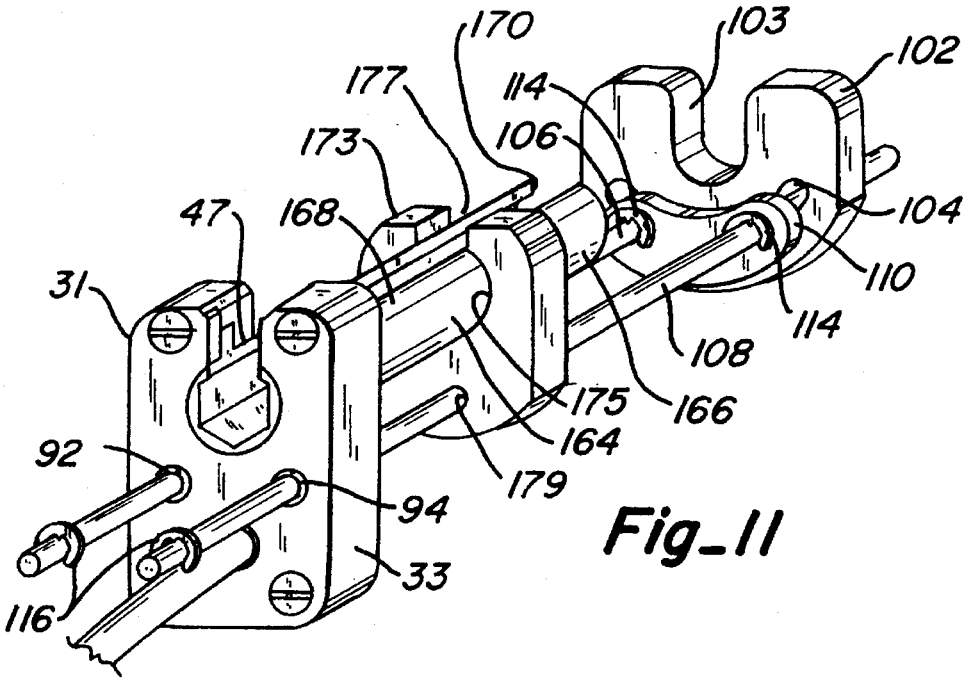
FIG. 11 is a perspective view of the torque reaction unit of this invention having an attachment for utilization with the socket of FIG. 11.

FIGS. 10 and 11 show an improved line fitting socket 164 of this invention utilizable with drive transfer assembly 31 of this invention. In many regards, including gap size and provision of sufficient facets to provide self maintenance on the fitting, socket 164 is similar to socket 30. However, integral shoulder 166 of side wall 168 is elongated toward its end 170 so that, when socket 164 is received in drive assembly 31, shoulder 166 extends through opening 47 a selected distance with end 170 spaced from housing 33 (various lengths of the extended socket can be provided, for example 0.5 or greater). In this manner, awkwardly positioned and/or tightly spaced fittings may be manipulated, the only space limitation being the thickness of side wall 168, using a socket of one piece construction.

As shown in FIG. 11, where fitting and/or line stabilization is desired, a stabilizing unit as heretofore described may be utilized with extended socket 164. In such case, however, it is desirable to provide reinforcement block 173 to assure that the somewhat elongated rods 106 and 108 are not twisted, damaged or caused to bind in apertures 92 and 94. Block 173 includes opening 175 for passage of socket 164 therethrough and rotation therein, opening 175 having gap 177 opening therefrom (about equal in size to the gap in side wall 168 of the socket). Openings 179 (only one of which can be seen in FIG. 11) receive different ones of rods 106 and 108 therethrough.

While only one type of extended socket is shown, it is to be understood that many configurations for the extended part of the head could be utilized, including enlarged or diminished socket openings, unusual inner periphery configurations, and the like.

Figure 12A:
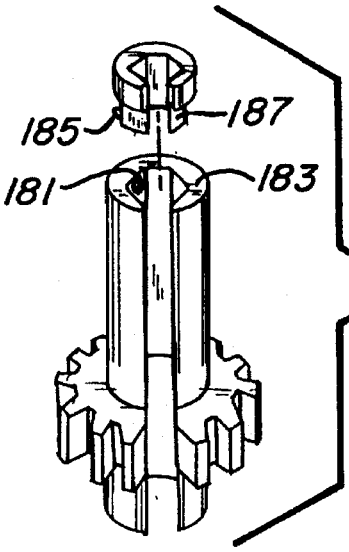
FIGS. 12A through 12C illustrate various interchangeable sockets of this invention utilizable with the drive and socket unit of this invention.
Figure 12C:
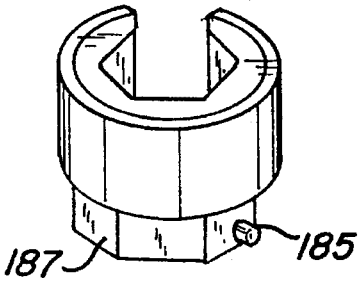
Figure 12B:
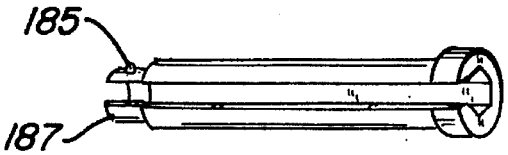

FIGS. 12A through 12C show only a few of the many configurations of attachments that could be utilized with the sockets of this invention where detent 181 is provided at terminus 183 of the socket (FIG. 12A). By providing ball plunger 185 (see FIG. 12 B) in the reduced insert 187 in the various attachments to be received in terminus 183, the ball of which is received in detent 181, interchangeable socket systems of many types and varieties can be provided.

What is claimed is:

1. A compact device for manipulating a threaded line fitting having first and second relatively rotatable engageable parts while the fitting is in place on the line, said device for releasable engagement with a driver, said device comprising:

a socket engageable with the second part of the threaded line fitting and having an inner periphery and an engageable outer periphery together defining a part of a side wall, said side wall having a gap therein to allow positioning of said socket around the line by passage of the line through said gap, said gap being defined between spaced edges of said side wall;

a compact drive transfer assembly including a housing having said socket rotatably mounted therein, said housing having a gap at one part thereof, and drive means for imparting rotational motion to said socket and having a primary drive gear and first and second linkage gears, said primary drive gear rotatably mounted in said housing and including a portion configured to be releasably engaged with the driver, and said first and second linkage gears rotatably mounted in said housing and each configured to engage said primary drive gear and said outer periphery of said socket for imparting rotational motion to said socket when said primary drive gear is rotated by the driver, at least one of said first and second linkage gears having an opening therethrough; and a reaction unit for stabilizing the first part of the threaded line fitting while the second part of the line fitting is being manipulated by said socket, said reaction unit including engaging means for engaging the first part of the threaded line fitting and at least a first stabilizing bar joined with said engaging means and slidably received through said opening through said at least one of said first and second linkage gears of said drive transfer assembly.

2. The device of claim 1 wherein said size of said gap is no more than about 75% of the fitting size.

3. The device of claim 1 wherein said socket and said primary drive gear are of a size so that said socket rotates more slowly than said primary drive gear.

4. The device of claim 3 wherein difference in rotation of said primary drive gear and said socket is about 1.25 revolutions to 1 revolution, respectively.

5. The device of claim 1 wherein both said first and second linkage gears have openings therethrough, and wherein said reaction unit includes a second stabilizing bar slidably received through an opening in a different one of said first and second linkage gears.

6. A reaction unit for stabilizing a first part of a threaded connector assembly, said unit for use with a device for manipulating a second part of the connector assembly one of engaged or intended for engagement with the first part to be stabilized by said unit, the device having a plurality of rotatable members a first one of which is utilized for engagement with and manipulation of the second part of the connector assembly, the members being mounted in a housing that is normally relatively stationary during the manipulation, said unit comprising:

engaging means for engaging the first part of the connector assembly; and stabilizing means joined with said engaging means and mountable through at least one of the rotatable members of the device for limiting movement of said engaging means during the manipulation of the second part of the connector assembly, said stabilizing means being configured to be movable through the at least one of the rotatable members of the device to accommodate relative movement of said engaging means and the device toward and away from one another.

7. The unit of claim 6 wherein said engaging means has an arcuate slot positioned therein which forms an arc spaced from and around to a selected degree the first part of the connector assembly, said stabilizing means being movably joined in said slot.

8. The unit of claim 7 wherein said selected degree is about 120°.

9. The unit of claim 6 wherein said stabilizing means is configured to be slidably received through the at least one of the rotatable members of the device.

10. The unit of claim 6 wherein said stabilizing means comprises first and second stabilizing bars positioned to be mountable through different ones of the rotatable members of the device.

11. The unit of claim 6 wherein the at least one of the rotatable members of the device has a threaded aperture, said stabilizing means having a threaded portion received in the threaded aperture of the at least first one of the rotatable members of the device.

12. The device of claim 1 wherein said gap defined between said spaced edges of said side wall of said socket has a size between said spaced edges less than the fitting size, said gaps being in register when said socket is rotated to a selected position.

13. A reaction unit for stabilizing a first part of a threaded line fitting assembly while the assembly is in place on the line, said unit for use with a device for manipulating a second part of the line fitting assembly one of engaged or intended for engagement with the first part to be stabilized by said unit, the device having a socket that is engagable with and rotatable for manipulating the second part of the line fitting assembly, a housing having the socket rotatably mounted therein and that is normally relatively stationary during the manipulation, a primary drive gear rotatably mounted in the housing and having a portion thereat for releasably engaging a power driver, and linkage means mounted in the housing and configured to engage the primary drive gear and the socket for imparting rotational motion to the socket when the primary drive gear is rotated by the driver, said linkage means having at least a first aperture thereat, said unit comprising:

engaging means for engaging the first part of the line fitting assembly; and stabilizing means joined with said engaging means and received through the first aperture at the linkage means of the device for limiting rotational movement of said engaging means during the manipulation of the second part of the line fitting assembly, said stabilizing means being configured to be movable through the first aperture to permit relative movement of said engaging means and the socket toward and away from one another.

14. The unit of claim 13 wherein said stabilizing means is shaped to be slidably receivable through the first aperture of the linkage means.

15. The unit of claim 12 wherein the linkage means includes first and second linkage gears rotatably mounted in the housing and each engaging the primary drive gear and an outer periphery of the socket, the first linkage gear having the first aperture therethrough and the second linkage gear having a second aperture therethrough, said stabilizing means comprising first and second stabilizing bars movably received in different ones of the apertures.

16. The unit of claim 14 wherein said bars are threaded at portions received in the apertures.

17. The unit of claim 15 wherein said bars are rods slidably receivable through the apertures.

18. The unit of claim 13 wherein said engaging means includes a portion for engaging the first part of the line fitting assembly and an arcuate slot spaced from said portion of said engaging means, said stabilizing means being receivable in said slot and laterally moveable therein.

19. The unit of claim 12 wherein the socket includes a fitting receiving side wall having a part extending to an end of the socket so that, when the socket is received in the device, the side wall extends through an opening in the housing with the end of the socket spaced a selected distance away from the device, said unit further comprising reinforcement means mounted on said stabilizing means between said engaging means and the device and having an opening therein configured to have the socket movably receivable therethrough.

* * * * *